United States Patent [19]

Badinier et al.

[11] Patent Number: 4,675,052

[45] Date of Patent: Jun. 23, 1987

[54] TOOL FOR CLEANING POURING RUNNERS

[75] Inventors: Christian Badinier, Metz; Alain Louhichi, Istres; Andre Annichini, Saint Martin De Crau; Alain Dufour, Saint Mitre Les Remparts, all of France

[73] Assignees: Societe Lorraine et Somafer, Fameck; Meridionale de Laminage Continu Solmer, Puteaux, both of France

[21] Appl. No.: 841,230

[22] Filed: Mar. 19, 1986

Related U.S. Application Data

[63] Continuation of Ser. No. 684,376, Dec. 20, 1984, abandoned.

[30] Foreign Application Priority Data

Dec. 22, 1983 [FR] France ..... 83 21038

[51] Int. Cl.[4] ..... B08B 9/02; C21B 7/14

[52] U.S. Cl. ..... 134/8; 15/93 R; 15/104.1 C

[58] Field of Search ..... 15/89, 91, 93 R, 104.07, 15/104.1 C, 3; 266/135, 137; 241/191; 134/6, 8, 22.1; 299/55, 14

[56] References Cited

U.S. PATENT DOCUMENTS 3,814,385 6/1974 Holmulund et al. .
3,917,233 12/1975 Blower .
4,407,037 10/1983 Kemble ..... 15/93 R
4,512,695 4/1985 Brun et al. ..... 15/93 R X

FOREIGN PATENT DOCUMENTS 2388646 11/1978 France .
64306/83 4/1983 Japan .
713605 2/1980 U.S.S.R. .
990330 1/1983 U.S.S.R. .
1094623 5/1984 U.S.S.R. .

*Primary Examiner*—Edward L. Roberts
*Attorney, Agent, or Firm*—Dennison, Meserole, Pollack & Scheiner

[57] ABSTRACT

A rotary reciprocal tool for attachment to a remotely controlled support arm includes a casing attached to the arm and enclosing a fluid pressure motor. The casing also provides a chamber into which pressure fluid is supplied for activating the motor. The tool further includes a working surface in generally arcuate configuration provided with a plurality of working protuberances to engage the surface to be treated and within the working portion of the tool a vibration generator is disposed to impact both reciprocal and rotary movement to the working portion. A damper element is positioned between the casing and the rotating reciprocal tool actuator to reduce the transmission of vibration from the working portion of the tool to the casing.

14 Claims, 3 Drawing Figures

TOOL FOR CLEANING POURING RUNNERS

Figure 1:
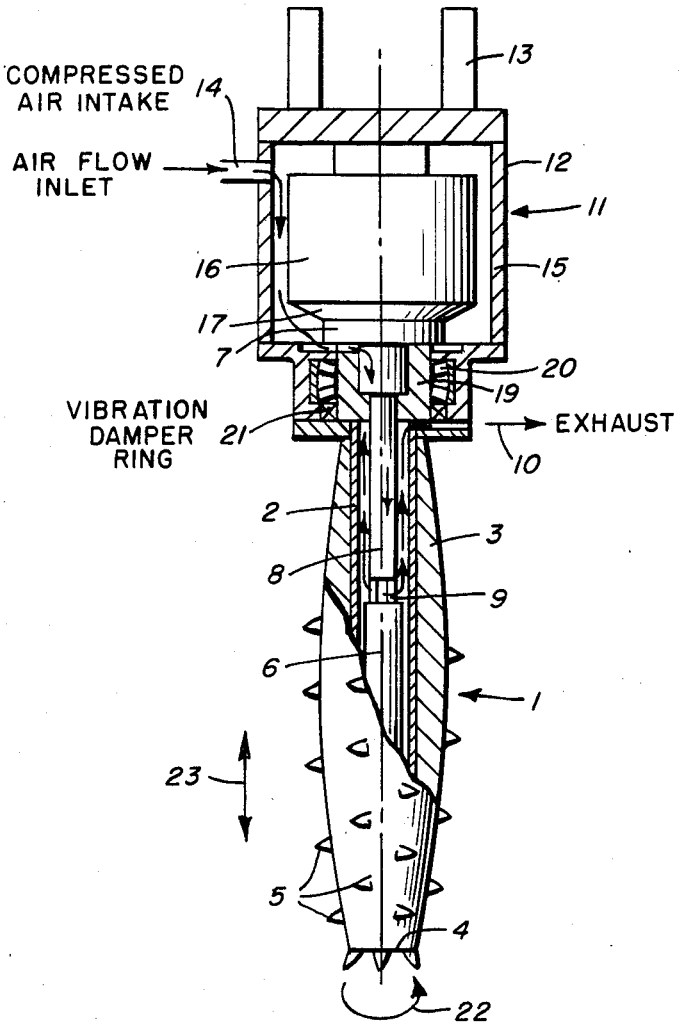

This is a continuation of copending application Ser. No. 684,376, filed Dec. 20, 1984, now abandoned.

The present invention concerns a tool for cleaning pouring runners and any other receptacle which is lined with a refractory material and the walls of which have been brought into contact with materials in a molten state.

In siderurgy as in the metallurgy of non-ferrous metals and any other kind of industry involving materials in a molten state, it is known to use receptacles or vessels either for storing such materials or for carrying them from one point of the processing installations to another. Thus, in siderurgy, blast furnaces are generally provided with conduits of trapezoidal cross-section which are upwardly open over at least a part of their length, being referred to as pouring channels or runners. The runners are intended to collect the liquid cast iron produced by the blast furnace to convey it to casting machines or refining ladles.

The runners are in most cases formed by a metal support structure which is internally lined with refractory portions.

Upon contact with the materials in a molten state, the lining of the runners gradually suffers deterioration due to abrasion and/or the effect of heat. In the long term, that may result in materials infiltrating as far as the metal support structure, which thus has to be taken out of operation due to holes being formed therein. Likewise, the lining may become progressively covered with deposits which are produced by solid substances which are entrained by the materials being carried in the runners, or due to partial, untimely solidification of those materials themselves. Such deposits then reduce the flow section of the runners and result in a reduction in the flow rate of material carried therein, that is to say, the processing capacity of the installation. Such deposits may even be the cause of the materials spilling over, which is an event that may be highly prejudicial to operator safety.

It is for that reason that there is a need periodically to clean out the runners either to prepare the walls thereof for repair to the lining and thus to keep that equipment in proper operating condition, or to remove the major part of the deposits and to restore a normal treatment capacity, besides increased safety.

At the present time, the cleaning operation is in most cases carried out manually by means of tools which are suited to that purpose to a greater or lesser degree. However, such a method suffers from a number of disadvantages:

first of all, it is slow and accordingly gives rise to relatively high levels of labour cost. The slowness of the method also results in the installation being shut down for a prolonged period of time, which in the case of use in a continuous mode, may give rise to the need to have recourse to standby material, thus increasing the capital investment costs, then, the method is limited in precision, which requires the operator to have a high level of skill in order not to damage the parts of the lining which are in a good condition, and finally, it is an arduous and distressing operation as it requires the operator to work in the proximity of receptacles which are at relatively high temperature, in an environment which is polluted by fumes and noise.

It is for that purpose that, in an endeavour to overcome those disadvantages, men skilled in the art have turned their attention to mechanising the cleaning operation.

However, in order to avoid having recourse to excessively sopisticated machines which are accordingly expensive, the men skilled in the art have sought to make use of handling machines which are generally used on sites of major works such as mines, dams, building sites, etc, adapting specific cleaning tools thereto.

When using such pieces of apparatus which are equipped with remote-control arms that can be easily handled, the operation is faster.

In addition, because of the precision with which the position of the tool may be controlled with respect to the receptacle, the action of the tool is applied only to the deposit or to the part which is to be restored, which makes it possible to avoid any untimely damage.

Finally, besides the large spread or range of their arms, which is a favourable consideration in regard to operating at a remote location, such pieces of equipment are mostly provided with cabins that are isolated from the ambient medium. The operator is thus protected from pollution and therefore operates under conditions in regard to hygiene and safety, that are markedly improved in comparison with the conditions involved when working manually.

Adaptations may be required in order to make such apparatuses suitable for the cleaning function, but they do not basically change the design thereof. In contrast, as regards the tool itself, the fact of being mechanised makes it possible for it to be produced with a structure and a mode of operation which are greatly different from those of the tools that are used manually.

Thus, in French patent No 2 504 829, the inventor designed a tool which is referred to as a 'milling head' comprising two narrow discs which rotate about an axis perpendicular to the axis of the arm of the apparatus used, the discs attacking the deposits by way of the peripheral surfaces thereof. The very fact that narrow discs are used means that the attack surface of the tool is relatively small in area and that a number of passes therefore have to be carried out in order entirely to clean one of the walls of the runner.

The inventor also designed a head in the form of a cylinder, one of the bases of which serves as the attack surface. The cylinder is mounted on the side of a milling arm which rotates in such a way that, by pivoting it through 180°, it can be used both for cleaning one of the side walls and for cleaning the other. However, here too a plurality of passes have to be carried out.

In addition, in that design, the milling head is driven by means of a chain mechanism which is mounted on the arm. However, such an assembly limits the value of the torque available for rotating the head, and therefore reduces its efficiency in the cleaning operation.

It is for that reason that, faced with the above-indicated teachings, the applicants felt the need to provide a novel tool whose design would make it possible to overcome all or part of the disadvantages which are found in the prior art. They therefore carried out research, the aim of which was to develop a tool which enjoys a higher degree of efficiency, that is to say, which is quicker in operation, while ensuring a high quality of work, irrespective of the nature and the state of the runners.

That aim pushed the applicants into finding the means for affording the tool the following possibilities:

carrying out the cleaning operation on one wall of the runner in a single pass, producing a torque higher than that developed by a chain drive system, and increasing the abrasion forces applied to the deposits.

The applicants achieved such a result by developing a tool which, according to the invention, is intended to be fitted to the end of the remote-controlled arm of a movable apparatus fitted with at least one hydraulic circuit and a compressed air source, and is characterized in that it comprises, in its operating position:

a lower movable portion formed by a hollow shaft within which is disposed a pneumatic vibration generator and the air supply system thereof, to the outside of which is fixed a lateral surface of revolution of oval shape, at least a part of which is provided with milling points or spikes, said movable portion being free to rotate about its axis and to be displaced parallel to said axis with a reciprocating movement, and an upper portion which is fixed with respect to the arm and which is formed by a sealed casing acting as an air reserve and which contains the stator and the rotor of a hydraulic motor, within which is fixed the end of the hollow shaft which is isolated from the casing by a vibration damper.

The tool therefore comprises a movable portion which constitutes the active portion of the tool.

On its exterior, the above-indicated portion has a lateral surface of revolution, with respect to its longitudinal axis, the shape thereof being that of an oval. That shape was selected as it is best suited to the cleaning operations to be carried out and by virtue of its minimum bulk at the head end and its large longitudinal attack surface area. The above-indicated shape is preferably dimensioned in accordance with the configuration of the runners so as to provide for maximum efficiency and to permit a wall to be cleaned in a single pass.

At least a portion of the lateral surface of revolution is provided with milling points or spikes. The latter are preferably disposed in a regular pattern in a helical configuration. Preferably, they are all in the same direction and have their axis tangential to the surface of revolution and disposed in a plane perpendicular to the generatrix of the surface at the point of contact.

Preferably, the lower end of the movbale portion is truncated forming a circular surface provided with points or spikes. That particular feature permits the tool to act on the bottom and the side walls of the runners without its having to be tilted through an angle of 180°, as was the case in the prior art.

Fixed within the above-mentioned lateral surface is an elongate hollow shaft which extends along the longitudinal axis of the movable portion and which is extended upwardly so as to be capable of passing into the interior of the fixed portion of the tool and to provide a mechanical connection to the rotor of a hydraulic motor which imparts to the whole of the movable portion a rotary movement about its axis. The fact that the shaft is directly coupled to the rotor avoids having recourse to the chain drive arrangements of the prior art, and makes it possible substantially to increase the torque available at the tool, when using a given motor.

The diameter of the hollow shaft is sufficient to allow the incorporation therewithin of a pneumatic vibration generator as well as its compressed air supply system which is connected to the air reserve which is within the fixed portion of the tool.

Likewise, the space between the generator and the inside wall of the shaft is sufficiently large to allow discharge of the expanded air which escapes from the generator and which is discharged from the tool by way of a lateral vent orifice.

Under the action of the generator, the movable portion of the tool is displaced parallel to its axis with a reciprocating movement; such a movement, being superimposed on the rotary motion, substantially increases the abrasion forces which are applied to the deposits to be removed, and gives the tool a very high level of efficiency.

The tool according to the invention also comprises an upper portion formed by a casing which is rigidly fixed to the end of the arm of the movable apparatus by means of mounting members which are well known in the tool-carrier art and which enable the successive coupling and uncoupling operations required to change a tool to be rapidly carried out.

The casing is sealed and serves as a compressed air reserve or store for the vibration generator. A pipe disposed on the side wall thereof permits it to be supplied with air from the compressor of the movable apparatus, by way of the arm.

Disposed within the casing is a hydraulic motor whose stator is fixed with respect to the wall and which communicates with the hydraulic circuit of the apparatus, the rotor of the motor being connected to the upper end of the hollow shaft. Besides rolling bearing members, the arrangement at that point also includes a vibration damper, a kind of ring of elastic material which is disposed around the end of the hollow shaft and which, by preventing vibration from being transmitted through the components of the fixed portion, prevents deterioration thereof.

The active portion of the tool admits of being operated by different kinds of hydraulic motors and vibration generators of the pneumatic hammer pick type, which are currently in use. The designs are selected in dependence on their dimensions and the required levels of performance.

The tool may be used on most movable apparatuses such as a power shovel or other piece of equipment which is used in earth-moving works, digging mine galleries, tunnels, etc.

The assembly of the tool is fitted to the end of the arm of the apparatus in such a way that the axis of revolution of the movbale portion is in a plane perpendicular to the axis of the arm. That arrangement makes it easier to carry out the cleaning operation.

Generally, the tool is oriented vertically but it may assume a different orientation with respect to the vertical, when certain particular regions of the runners have to be cleaned.

In operation, under the combined action of the rotary motion and the reciprocating movement of the movable portion of the tool, the milling points or spikes vigorously attack the deposits so that the cleaning operation is carried out quickly and with a very high degree of precision, due to the flexibility of handling of the arm.

The speed of rotation of the tool is preferably between 50 and 500 revolutions per minute and the frequency of its reciprocating movement is between 5 and 60 Hertz. The optimum values are selected independence on the nature of the deposit and the dimensions of the runners to be cleaned. Outside of those ranges, a reduction in the level of efficiency is found when using lower values, while when higher values are used, there is a tendency to excessive wear on the milling points or spikes.

As regards the frequency of the vibrations which communicates the reciprocating movement to the movable portion of the tool, it has been found that it was preferable, for cleaning certain runners, to vary the vibration frequency in the course of operation of the tool in order to operate under maximum conditions of efficiency of the tool.

Such variations are achieved by controlling the flow rate of air feeding the generator either manually or preferably under the control of a programmed cycle.

Figure 3:
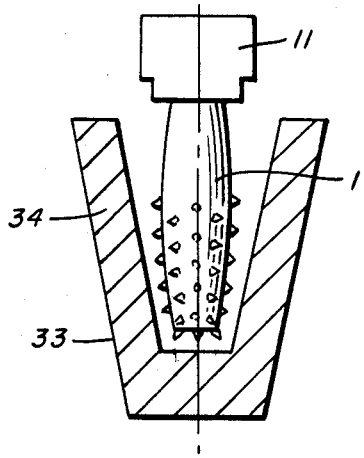
Figure 2:
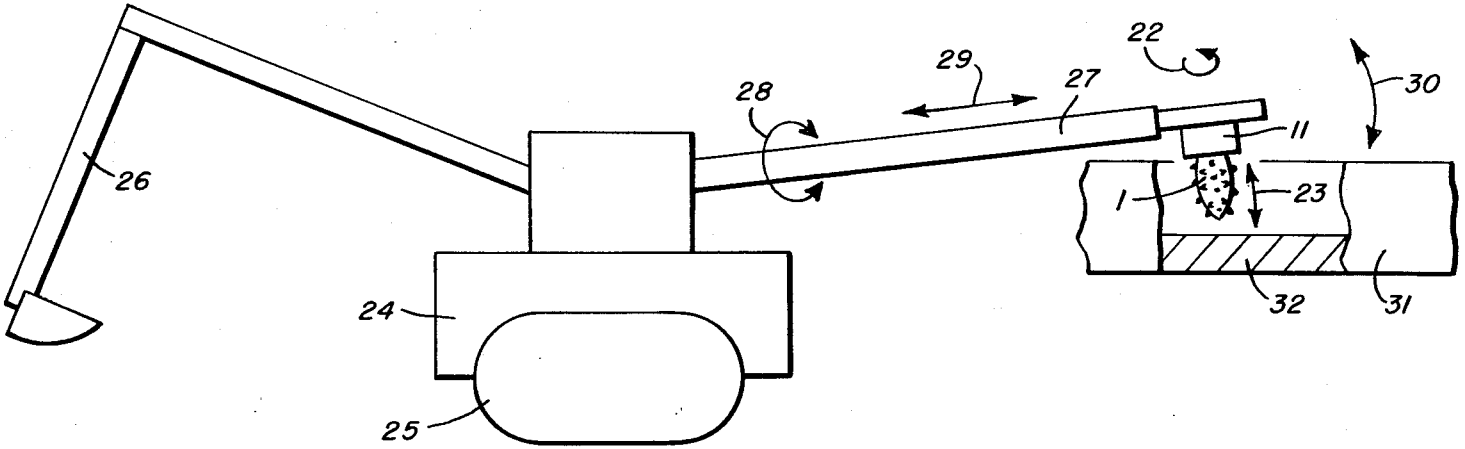

The invention will be better appreciated from the accompanying drawings in which:

FIG. 1 shows a side view partly in axial section of the tool according to the invention, FIG. 2 is a diagrammatic side view of an apparatus provided with a tool according to the invention, in a cleaning position in a pouring runner which is viewed from the side, partly in section along the longitudinal axis thereof, and FIG. 3 shows a side view of the tool in its operating position, in a runner, in cross-section taken perpendicular to its longitudinal axis.

Referring to FIG. 1, shown therein is the lower movable portion 1 which is formed by a hollow shaft 2 around which is fixed a lateral surface of revolution as indicated at 3, which is truncated at one of its ends to form a circular surface 4, both the lateral surface and the circular surface being provided with milling points or spikes 5. Disposed within the hollow shaft is the pneumatic vibration generator 6, its compressed air supply system comprising a feed duct 7, a pipe 8 and its discharge system 9 which leads to the vent 10. Also shown in FIG. 1 is the upper portion 11 which is surrounded by a casing 12 provided with members 13 for fitting it to the arm, and a compressed air intake pipe 14 which communicates with the air reserve 15 which itself communicates with the feed cut 7. Disposed within the casing are the stator 16 of the hydraulic motor, the rotor 17 thereof which is mechanically connected to the end 19 of the hollow shaft which is surrounded by the rolling bearing members 20, and the damper ring 21. The arrows 22 and 23 respectively indicate the sense and the direction of the rotary and reciprocating movements of the movable portion.

Referring to FIG. 2, shown therein is a machine or apparatus 24 fitted with tracks 25, a digging arm 26 which is intended to remove the substances resulting from the cleaning operation, and an arm 27 which can rotate about its axis as indicated by the arrow 28, which can be shortened or lengthened as indicated by the arrow 29, and which can be raised or lowered as indicated by the arrow 30. Disposed at the end of the arm 27 is a tool according to the invention, the axis of which is disposed in a plane perpendicular to the axis of the arm and which comprises a fixed portion 11 and a movable portion 1 provided with points or spikes. The tool operates along a runner 31 which is provided with a lining 32, while rotating about its axis of rotation as indicated by the arrow 22 and being displaced with a reciprocating movement as indicated by the arrow 23.

FIG. 3 shows the tool with its movable portion 1 and its fixed portion 11 in the operating position in a runner 33 which is lined with a refractory material 34.

The invention may be illustrated by means of the following example of use thereof.

A Poclain handling machine fitted with an arm whose length varies by 3 meters and which may be operated with a rotational movement about its axis and which is displaced in a vertical plane over an angle of 45° upwardly with respect to the horizontal and 30° downwardly, having a hyraulic circuit operating under a pressure of 350 MPa and a compressed air circuit operating under a pressure of 0.9 MPa, was fitted with a tool according to the invention. The tool consisted of a casing whose overall dimensions were 540×430 mm, within which was disposed a hydraulic motor of type 1155, of such a size that it left space for an air reserve of 20 liters.

As regards the movable portion of the tool, that was formed by a lateral surface of revolution, made of steel, being in the form of an oval, the length thereof being 1100 mm, the maximum diameter being 220 mm and the minimum diameter at the level of the truncated end being 150 mm. 75 milling points or spikes of carbide were distributed over the surface of the tool, on the lower half of the length thereof, 4 of those points or spikes being positioned on the circular surface. The lateral surface member was fixed along the line of its axis on a hollow shaft which was 100 mm in diameter and within which were disposed the pneumatic vibration generator and the compressed air supply system thereof.

Operated with a rotary movement at a speed of 300 revolutios per minute and a reciprocating movement at a frequency of 40 Hertz, the tool was used to clean a blast furnace runner which was 1500 mm in length and 620 mm in height, lined with a deposit of ferrous metals and slag, with a mean thickness of from 60 to 80 mm. The operation of cleaning the runner over a length of 1500 mm was carried out in two hours, whereas such an operation when performed manually would have required five hours.

A tool which enjoys such a level of efficiency is used in cleaning runners or any other receptacle or vessel lined with refractory materials which have been in contact with substances in a molten condition and the walls of which have to be cleaned of deposits with which they are covered either to return them to their initial dimensions or to permit them to be reconditioned.

We claim:

1. A tool for cleaning a refractory lined pouring runner or like metallurgical receptacle by removing deposits on said lining, said tool being adapted to connect to a remote controlled arm, said tool comprising a member to connect said tool to said arm, a casing portion connected to said member, and a removable portion connected to said casing, said casing portion containing a hydraulic motor, said motor having a stator and rotor, said movable portion having on the outside thereof milling protruberances, a pneumatic vibration generator extending from within said casing portion into said movable portion, said casing portion defining an air reservoir for said pneumatic vibration generator and having an inlet for entry of said air and an outlet to exhaust said air with said air being directed under pressure past said pneumatic vibration generator in its travel from said inlet to said outlet whereby in use, said movable portion is caused to mill said deposits off said refractory lining and during said milling is moved both by rotation and reciprocation, and vibration damper means are present to reduce the transmission of vibration from said movable portion to said casing.

2. A tool according to cliam 1, wherein said movable portion includes a hollow shaft and said pneumatic vibration generator is disposed within said shaft and said compressed air travels in said hollow shaft.

3. A tool according to claim 2, wherein said rotor is mechanically connected to the adjacent end of said hollow shaft.

4. A tool according to claim 3, wherein said vibration damper means comprises a damper ring which surrounds said adjacent end of said hollow shaft.

5. A tool according to claim 1, wherein said inlet for said air includes a pipe for connection to a compressor located on movable apparatus with said remote-controlled air.

6. A tool according to claim 1, wherein the flow rate of air intended to produce the reciprocating movement of the movable portion thereof is variable.

7. A tool according to claim 1, wherein the external form of said movable portion is adapted to the profile of said runner or receptacle to be cleaned.

8. A tool according to claim 7, wherein said movable portion is substantially oval in shape.

9. A tool according to claim 7, wherein the lower end of said movable portion is truncated defining a circular surface fitted with miling protruberances.

10. A tool according to claim 1, wherein said milling protruberances extend in the same direction and have their axes tangential to the surface of the movable portion and are disposed in a plane perpendicular to said vibration genrator.

11. A tool according to claim 1, wherein said tool is fitted to the end of said arm in such a way that the axis of revolution of said movable portion is disposed in a plane perpendicular to the longitudinal axis of said arm.

12. A method of cleaning a refractory lined pouring runner or like metallurgical receptacle free of deposits on said lining, said method comprising introducing a tool adjacent said deposits, said tool being at the end of a remote controlled arm, said tool comprising a member connecting said tool to aid arm, a casing portion connected to said member, and a movable portion connected to said casing, said casing portion containing a hydraulic motor, said motor having a stator and a rotor, said movable portion having on the outside thereof milling protruberances, a pneumatic vibration generator extending from within said casing portion into said movable portion, said casing portion defining an air reservoir for said pneumatic vibration generator and having an inlet for entry of said air and an outlet to exhaust said air with said air being directed under pressure past said pneumatic vibration generator in its travel from said inlet to said outlet, whereby in use, said movable portion is caused to mill said deposits off said refractory lining and during said milling is moved both by rotation and reciprocation, and vibration damper means are present to reduce the transmission of vibration from said movable portion to said casing, said method comprising actuating said hydraulic motor and said supply of air whereby said movable portion is caused to mill said deposits off said lining by being moved by both rotation and reciprocation.

13. A method according to claim 12, wherein said speed of rotation of said movable portion thereof is between 50 and 500 revolutions per minute and said reciprocating movement of said movable portion thereof is at a frequency of between 5 and 60 Hertz.

14. A method according to claim 12, wherein said frequency of said vibration is varied during the cleaning operation by controlling the flow rate of said air.

* * * * *